US009008900B2

(12) United States Patent
Wildner

(10) Patent No.: US 9,008,900 B2
(45) Date of Patent: Apr. 14, 2015

(54) METHOD AND DEVICE FOR DETERMINING A HEIGHT OF LIFT OF A WORKING MACHINE

(75) Inventor: Oliver Wildner, Hardthausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/816,864

(22) PCT Filed: Jul. 29, 2011

(86) PCT No.: PCT/EP2011/063105
§ 371 (c)(1),
(2), (4) Date: Apr. 22, 2013

(87) PCT Pub. No.: WO2012/022598
PCT Pub. Date: Feb. 23, 2012

(65) Prior Publication Data

US 2013/0204489 A1 Aug. 8, 2013

(30) Foreign Application Priority Data

Aug. 18, 2010 (DE) ..... 10 2010 039 471

(51) Int. Cl.
*B66F 9/06* (2006.01)
*B66F 9/075* (2006.01)
*B66F 9/24* (2006.01)

(52) U.S. Cl.
CPC ..... *B66F 9/0755* (2013.01); *B66F 9/24* (2013.01)

(58) Field of Classification Search
CPC ..... B66F 9/06; B66F 9/391; B66F 9/393; B66F 9/394; B66F 9/399
See application file for complete search history.

(56) References Cited

U.S. PATENT DOCUMENTS

| | | | | | |
|---|---|---|---|---|---|
| 4,122,957 | A | * | 10/1978 | Allen et al. | 414/281 |
| 4,130,183 | A | * | 12/1978 | Tjornemark | 187/224 |
| 4,547,844 | A | * | 10/1985 | Adams | 700/84 |
| 4,942,529 | A | * | 7/1990 | Avitan et al. | 701/50 |
| 5,011,358 | A | * | 4/1991 | Andersen et al. | 414/273 |
| 5,103,226 | A | * | 4/1992 | Dammeyer et al. | 341/14 |
| 5,341,695 | A | * | 8/1994 | Avitan | 73/865.8 |
| 5,749,696 | A | * | 5/1998 | Johnson | 414/635 |
| 6,138,795 | A | * | 10/2000 | Kamiya | 187/223 |
| 6,173,233 | B1 | | 1/2001 | Janutka et al. | |

(Continued)

FOREIGN PATENT DOCUMENTS

| | | |
|---|---|---|
| CN | 1255572 | 6/2000 |
| CN | 2506690 | 8/2002 |

(Continued)

OTHER PUBLICATIONS

International Search Report for PCT/EP2011/063105 dated Oct. 7, 2011.

*Primary Examiner* — Jonathan M Dager
(74) *Attorney, Agent, or Firm* — Kenyon & Kenyon LLP

(57) ABSTRACT

In a method for determining a height of lift of a working machine, a measurement of height is carried out between a position along an approximately vertical axis of motion of a lifting element of the working machine and a reference point. In order to implement a correct determination of the height of lift even in response to inhomogeneous ground conditions, the ground on which the working machine is located is used as the reference point, and for the height measurement a plurality of measuring signals are ascertained, which are supplied to a mean value formation, the mean value being drawn upon for determining the height of lift.

11 Claims, 1 Drawing Sheet

(56) References Cited

U.S. PATENT DOCUMENTS

| | | | | |
|---|---|---|---|---|
| 6,286,629 | B1 * | 9/2001 | Saunders | 187/394 |
| 6,296,081 | B1 * | 10/2001 | Nagai et al. | 187/394 |
| 6,345,694 | B1 * | 2/2002 | Volker | 187/223 |
| 6,533,076 | B1 * | 3/2003 | Haverfield et al. | 187/394 |
| 7,287,625 | B1 * | 10/2007 | Harris | 187/282 |
| 7,344,351 | B2 * | 3/2008 | Rokusek et al. | 414/699 |
| 7,735,609 | B2 * | 6/2010 | Ito et al. | 187/277 |
| 8,230,976 | B2 * | 7/2012 | Baldini | 187/226 |
| 8,521,373 | B2 * | 8/2013 | Behncke et al. | 701/50 |
| 8,600,628 | B2 * | 12/2013 | Haemmerl et al. | 701/50 |
| 2003/0001751 | A1 * | 1/2003 | Ogura et al. | 340/691.6 |
| 2004/0158355 | A1 * | 8/2004 | Holmqvist et al. | 700/245 |
| 2006/0005415 | A1 * | 1/2006 | Hammerl et al. | 33/706 |
| 2007/0080025 | A1 * | 4/2007 | Yamada et al. | 187/224 |
| 2009/0101447 | A1 * | 4/2009 | Durham et al. | 187/238 |
| 2011/0099962 | A1 * | 5/2011 | Coers et al. | 56/10.4 |
| 2013/0006484 | A1 * | 1/2013 | Avitzur et al. | 701/50 |
| 2013/0091819 | A1 * | 4/2013 | Deneault et al. | 56/10.2 E |
| 2013/0182237 | A1 * | 7/2013 | Viereck et al. | 356/3 |

FOREIGN PATENT DOCUMENTS

| | | |
|---|---|---|
| CN | 2526781 | 12/2002 |
| DE | 23 08 450 | 9/1974 |
| DE | 29 32 899 | 8/1979 |
| DE | 102 34 730 | 2/2004 |
| DE | 103 49 762 | 5/2005 |
| DE | 10 2006 012 205 | 9/2007 |
| DE | 10 2007 020 182 | 10/2008 |
| DE | 10 2007 055 363 | 5/2009 |
| DE | 10 2008 020 170 | 11/2009 |
| EP | 1 834 922 | 9/2007 |
| EP | 1 886 966 | 8/2008 |
| JP | 20 38 300 | 2/1990 |
| JP | 2001-99631 | 4/2001 |
| JP | 2005 187 117 | 7/2005 |
| WO | WO 01/68507 | 9/2001 |

* cited by examiner

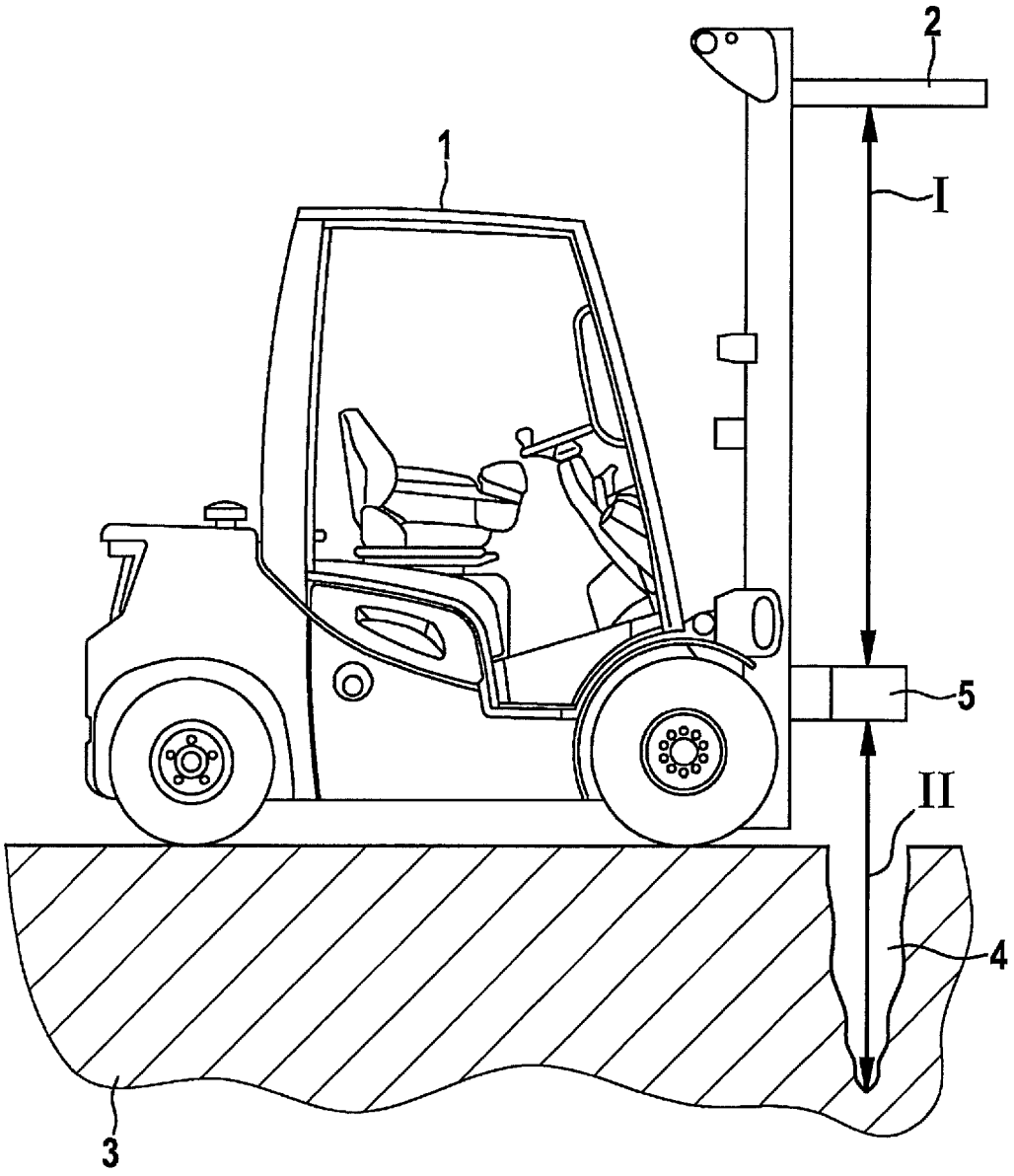
2
1
I
5
II
4
3

METHOD AND DEVICE FOR DETERMINING A HEIGHT OF LIFT OF A WORKING MACHINE

BACKGROUND OF THE INVENTION

1. Field of the Invention

The present invention relates to a method for determining a height of lift of a working machine, in which a measurement of height is carried out between a position along an approximately vertical axis of motion of a lifting element of the working machine and a reference point.

2. Description of the Related Art

In the case of a working machine, such as a high shelf stacking machine, the operator selects the desired height of lift of the lifting element by pressing a button, whereupon the lifting element automatically assumes the desired height of lift. For this purpose, it is necessary that the heights of the individual high shelf sections be entered into the controller of the working machine ahead of time.

Height measurement systems are situated on the working machine, which measure the height of lift between the lifting element and a reference point, the reference point usually being a fixed point on the housing of the working machine. The distance of the fixed point from the ground, in this context, is added as a fixed value to the measured height of lift from the reference point to the lifting element.

Since the distance of the reference point from the ground is considered to be a fixed quantity, it may happen, as a result of inhomogeneous ground conditions, such as cracks in the ground, that the height of lift is not correct at the position of the lifting going on, and the lifting element of the high shelf stacking machine does not take up the required height of lift for reaching a certain section of the high shelf. The operator then has to readjust the height of lift manually, which is very time-consuming.

BRIEF SUMMARY OF THE INVENTION

The object of the present invention is, therefore, to provide a method and a device for determining the height of lift at which, in spite of a local unevenness of the ground, the correct one is always output.

According to the present invention, the object is attained in that the ground is used as the reference point on which the working machine is located, and for the height measurement a plurality of measuring signals are ascertained, which are supplied to a mean value formation, the mean value being drawn upon for determining the height of lift. This has the advantage that the inhomogeneous ground condition is equalized by the mean value formation. Consequently, the correct lifting height is output at each position of the lifting event, without the operator having to readjust manually. The mean value formation simultaneously has the additional advantage that faulty reflections during a measurement or sensor errors are compensated for.

The lifting height is advantageously determined by two height measurement systems measuring vis-a-vis each other, a first partial height of lift being determined from a first fixed point on the working machine up to the lifting element and a second partial height of lift from a second fixed point on the working machine to the ground being ascertained. By dividing the measurement of the height of lift, the evaluation is simplified.

In one embodiment, the mean value formation is used on the measuring signals for determining the second partial height of lift, and for determining the height of lift of the lifting element above the ground which adds the second partial height of lift determined via the mean value to the first partial height of lift ascertained free from the mean value. In this instance, the measuring signals are averaged over a longer period, so that the unevennesses in the ground may indeed be reliably eliminated from the measured value. Since the mean value formation is used only for determining the second partial height of lift from the second fixed point to the ground, it is ensured that locally limited ground unevennesses do not corrupt the measurement of the height of lift.

In one further refinement, the first fixed point on the working machine and the second fixed point on the working machine are situated approximately at the same height, the first and the second partial height of lift being added to the height of lift. Because of the agreement in position of the two fixed points, no corrections are required in the determination of the height of lift.

Alternatively, the first fixed point and the second fixed point on the working machine are separated from each other by an approximately vertical distance, and to determine the height of lift of the lifting element above the ground, the distance between the first and the second fixed point is added to the first and the second partial height of lift. Because of this corrective measure, it is ensured that the height of lift is always correctly determined.

For determining the second partial height of lift, the ground is advantageously scanned at low frequency, particularly continuously. Because of the continuous scanning, it is ensured in the travel motion of the working machine that the height of lift is always output which corresponds to the current position of the working machine at which a lifting process is being carried out.

One refinement of the present invention relates to a device for determining the height of lift of a working machine which is determined by a height measurement system between the approximately vertical measurement of the lifting element of the working machine and a reference point. In order to state a correct height of lift in spite of inhomogeneous ground conditions, the ground on which the working machine is located is used as a reference point, and there are means present which ascertain a plurality of measuring signals for determining the height of lift, which are supplied to a mean value formation, for eliminating ground unevennesses, the mean value characterizing the height of lift. It is ensured, thereby, that at each position of the working machine during the lifting event, the correct height of lift is always output automatically, and the lifting element always reaches the appropriate story of the high shelf installation.

Advantageously, two height measurement systems measuring towards each other are used, a first height measurement system determining a first partial height of lift from a first fixed point on the working machine to the lifting element, and a second height measuring system ascertaining a second partial height of lift from a second fixed point on the working machine down to the ground, the measuring signals for the determination of the second partial height of lift being evaluated by the mean value formation. By this subdivision into two partial heights of lift, the two height measurement systems are able to be situated at a position on the working machine where direct access to the energy supply and communications devices is available.

In one variant, the two height measuring systems each include a sensor for the wireless determination of the first and the second partial height of lift. Because of this, the heights of lift are particularly advantageously ascertained, since the sensors include evaluation electronics, and for this reason, no additional parts are required for height measurement, which reduces the cost of the measurement of height of lift.

In one refinement, at least one sensor is developed as a laser sensor or an ultrasonic sensor. In the case of a laser sensor or an ultrasonic sensor, commercially available height measurement systems are involved, which is why no research and development costs are created when using such a height measurement system.

BRIEF SUMMARY OF THE DRAWING

FIG. 1 shows a representation in principle of height of lift measurement of a working machine.

DETAILED DESCRIPTION OF THE INVENTION

FIG. 1 shows a representation in principle of height of lift measurement on a working machine. In this instance, the example of a fork lift truck is taken into account, which has to assume different heights of lift, in order to stack a high shelf having a plurality of stories, for example. In this context, working machine 1 has a lifting element 2, which is able to be adjusted at right angles to the direction of propulsion of working machine 1. Working machine 1 is situated movably on ground 3, ground 3 having unevennesses which are clarified by the example of a crack 4. On the bumper of working machine 1, a height of lift measurement system 5 is situated, which is made up of two height measurement systems. The two height measurement systems 5 are situated side-by-side on working machine 1, at the same height, which is why in FIG. 1 only one height of lift measurement system is to be seen. The first height of lift measurement system, in this instance, measures from the position at the bumper up to lifting element 2, while the second height of lift measurement system measures from the point at the bumper of working machine 1 vertically down to ground 3. The positioning of two different height of lift measurement systems 5 at the bumper of the fork lift truck brings about the simplification that the energy supply of the height of lift measurement system and the communications of the height of lift measurement systems may be connected, without great complication, directly from working machine 1 to height of lift measurement systems 5.

Each height of lift measurement system 5 is developed, in this instance, as a sensor including an evaluation electronics system, which emits a measuring beam, such as, for example, a laser sensor or an ultrasonic sensor. The first height of lift measurement system transmits a measuring beam towards lifting element 2, which reflects this measuring beam. The second height of lift measurement system transmits the measuring beam towards ground surface 3, where it is also reflected. The respective reflected beams are received again and evaluated by the first and the second height of lift measurement system. The two sensor systems, in this context, work according to the same principle, in which the time between the transmission of the measuring beam and the receiving of the reflected beam is determined. From this, a first partial height of lift I is ascertained by the first height of lift measurement system, while a second partial height of lift II is determined by the second height of lift measurement system.

Since local ground unevennesses, such as crack 4, corrupt the measured value of second partial height of lift I, for the determination of second partial height of lift II, a plurality of measuring signals are ascertained one after the other over a longer period, which are supplied to a mean value formation. The mean value that is output is used as the mean value for second partial height of lift II. Consequently, it is ensured that local, limited ground unevennesses do not corrupt the measurement of the height of lift. After the output of the mean value, it is added to first partial height of lift I, which was ascertained by the first height measurement system in the direction of lifting element 2. This measurement took place free from a mean value.

Because of the mean value formation, local ground unevennesses have a negligible effect on the measured value of second partial height of lift II.

Alternatively, individual measuring signals, which deviate very greatly from the usual measuring signals, remain not taken into account in the mean value formation. It is thereby avoided that obviously faulty measurements or great ground unevennesses that occur corrupt the mean value.

By the continuous determination of second partial height of lift II, it is ensured that, in the selection of a height of lift by the operator by push button, the height of lift corresponding to the local conditions is always automatically set, without a manual readjustment by the operator becoming necessary.

The present invention may not only be used in the case of the usual fork lift trucks but may also be advantageously used in the case of high shelf stacking equipment or lifting platforms.

What is claimed is:

1. A method for determining an overall height of lift of a lifting element of a working machine, comprising:

sensing, by a sensor system, a height between a position along an approximately vertical axis of motion of the lifting element of the working machine and at least one reference point, wherein the ground on which the working machine is located is used for the at least one reference point, and wherein, for the measurement of height, multiple measuring signals are ascertained; and calculating, by evaluation electronics, a mean value of the multiple measuring signals, wherein the mean value is used for determining the overall height of lift.

2. The method as recited in claim 1, wherein the sensor system includes two height measurement systems, a first partial height of lift being determined, using a first of the two height measurement systems, from a first fixed point on the working machine up to the lifting element, and a second partial height of lift being ascertained, using a second of the two height measurement systems, from a second fixed point on the working machine down to the ground.

3. The method as recited in claim 2, wherein:

the multiple measuring signals are obtained using the second of the two height measurement systems, and wherein the second partial height is determined based on the mean value of the multiple measuring signals; and for determining the overall height of lift of the lifting element above the ground, the second partial height of lift determined based on the mean value of the multiple measuring signals is added to the first partial height of lift which is ascertained without using a mean value calculation.

4. The method as recited in claim 1, wherein the first fixed point on the working machine and the second fixed point on the working machine are situated approximately at the same height, and wherein the first partial height of lift and the second partial height of lift are added to determine the overall height of lift.

5. The method as recited in claim 3, wherein:

the first fixed point and the second fixed point on the working machine are approximately vertically separated from each other by a distance; and the distance between the first and the second fixed points is added to the first partial height of lift and the second partial height of lift to determine the height of lift of the lifting element above the ground.

6. The method as recited in claim 2, wherein, for determining the second partial height of lift, the ground is scanned at low frequency.

7. A height measurement system for determining an overall height of lift of a lifting element of a working machine, comprising:

sensors; and evaluation electronics;

wherein:

the sensors and evaluation electronics are communicatively coupled and configuration of the evaluation electronics is such that the determination of the overall height of lift is performable by the evaluation electronics (a) receiving input from the sensors indicating a height between a position along an approximately vertical axis of motion of the lifting element of the working machine and at least one a reference point, and (b) forming a mean value of the multiple measuring signals;

the ground on which the working machine is located is used for the at least one reference point; and the multiple measuring signals are used for the determination of the overall height of lift.

8. The device as recited in claim 7, wherein the height measurement system includes two height measurement devices located substantially side-by-side, the first height measurement device determining a first partial height of lift from a first fixed point on the working machine up to the lifting element, and the second height measurement device ascertaining a second partial height of lift from a second fixed point on the working machine down to the ground, wherein the multiple measuring signals are obtained using the second height measurement device, and wherein the second partial height is determined based on the mean value of the multiple measuring signals.

9. The device as recited in claim 8, wherein the first height measurement device includes a first sensor for wireless determination of the first partial height of lift and the second height measurement device includes a second sensor for wireless determination of the second partial height of lift.

10. The device as recited in claim 9, wherein at least one of the first and second sensors is configured as one of a laser sensor and an ultrasonic sensor.

11. The method as recited in claim 2, wherein the two height measurement systems are situated side-by-side.

* * * * *